US012408756B1

(12) United States Patent
Olarte

(10) Patent No.: US 12,408,756 B1
(45) Date of Patent: Sep. 9, 2025

(54) STACKING CHAIR WITH REMOVABLE BACK

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 115 days.

(21) Appl. No.: 18/325,463

(22) Filed: May 30, 2023

Related U.S. Application Data

(60) Provisional application No. 63/346,638, filed on May 27, 2022.

(51) Int. Cl.

| | |
|---|---|
| ***A47C 3/04*** | (2006.01) |
| ***A47C 4/02*** | (2006.01) |
| ***A47C 5/06*** | (2006.01) |
| ***A47C 5/10*** | (2006.01) |
| ***A47C 7/02*** | (2006.01) |
| ***A47C 7/18*** | (2006.01) |
| ***A47C 7/22*** | (2006.01) |

(Continued)

(52) U.S. Cl.

CPC ..... *A47C 3/04* (2013.01); *A47C 4/02* (2013.01); *A47C 4/028* (2013.01); *A47C 5/06* (2013.01); *A47C 5/10* (2013.01); *A47C 7/0213* (2018.08); *A47C 7/18* (2013.01); *A47C 7/22* (2013.01); *A47C 7/24* (2013.01); *A47C 7/42* (2013.01)

(58) Field of Classification Search

None

See application file for complete search history.

(56) References Cited

U.S. PATENT DOCUMENTS

| | | | |
|---|---|---|---|
| 62,428 | A | 2/1867 | Koechling |
| 146,432 | A | 1/1874 | Close |

(Continued)

FOREIGN PATENT DOCUMENTS

| | | | |
|---|---|---|---|
| AU | 2008219128 | A1 | 8/2008 |
| AU | 2019204076 | B2 | 1/2020 |

(Continued)

OTHER PUBLICATIONS

Canadian Office Action, PCT US2019061755, Jul. 27, 2022.

IP Australia, Australian Government Patent Examination Report No. 1 Application No. 2012304735, Jun. 18, 2015.

*Primary Examiner* — Robert Canfield

(74) *Attorney, Agent, or Firm* — MALLOY & MALLOY, PL.

(57) ABSTRACT

A stacking chair system comprising a frame with four legs, two being front legs and two being rear legs. The seat is secured to the frame, the seat being upholstered and including a foam cushion supported by flexible support. Two receivers in the frame are at a rear of the frame and between the rear legs of the frame. A backrest comprising a foam cushion is upholstered and has an inner frame supporting the foam cushion, the inner frame including two protrusions extending out of the upholstery wherein the each one of the two protrusions is configured to insert into one of the two receivers. A fastener is provided for each receiver and is configured to secure the protrusion to the corresponding receiver. The backrest is removable upon removal of the fasteners.

18 Claims, 6 Drawing Sheets

(51) Int. Cl.
*A47C 7/24* (2006.01)
*A47C 7/42* (2006.01)

(56) References Cited

U.S. PATENT DOCUMENTS 216,307 A 6/1879 Case
252,533 A 1/1882 Smith
272,166 A 2/1883 Shepler
315,618 A 4/1885 Harwood
326,571 A 9/1885 Lancaster
646,290 A 3/1900 Kratz
669,089 A 3/1901 Lambert
688,878 A 12/1901 Neuendorff
1,010,557 A 12/1911 Wilkinson
1,152,480 A 9/1915 Bouk
1,374,467 A 4/1921 Park
1,662,378 A 3/1928 Duke
1,695,101 A 12/1928 Hoffman
1,743,802 A 1/1930 Andress
1,800,387 A 4/1931 Greist
1,810,888 A 6/1931 Hanson
1,922,582 A 8/1933 Goodrich
1,941,340 A 12/1933 Dellert
1,973,178 A 9/1934 Sass
2,000,172 A 5/1935 Hanson
2,044,473 A 6/1936 Geller
2,070,387 A 2/1937 Vandervoort
2,098,711 A 11/1937 Rastetter
2,232,205 A 2/1941 Boardman
2,290,556 A 7/1942 Hard
2,304,223 A 12/1942 Westrope
2,492,103 A 12/1949 Merrill
2,492,111 A 12/1949 Prosser et al.
D156,935 S 1/1950 Carlson
2,500,124 A 3/1950 Hoven
2,516,728 A 7/1950 Smith
2,518,381 A 8/1950 Runkles
D165,457 S 12/1951 Hoven et al.
2,608,238 A 8/1952 Larsen et al.
2,610,335 A 9/1952 Baptista
2,610,669 A 9/1952 Bromagem
2,620,858 A 12/1952 Hoven et al.
2,621,709 A 12/1952 Bell
2,652,881 A 9/1953 Rowe
2,688,997 A 9/1954 Miller
2,750,993 A 6/1956 McGregor
2,812,120 A 11/1957 Beall, Jr.
2,815,972 A 12/1957 Lagervall
2,828,803 A 4/1958 Howe et al.
2,842,187 A 7/1958 Hendrickson
2,853,119 A 9/1958 Balfour
2,913,039 A 11/1959 Mauser
2,915,223 A 12/1959 Beall, Jr.
2,942,652 A 6/1960 Chapman
2,986,201 A 5/1961 McCartan
3,087,755 A 4/1963 Boman
3,098,677 A 7/1963 Williams
3,102,754 A 9/1963 Junkunc
3,114,575 A 12/1963 Eames
3,137,527 A 6/1964 Hoven et al.
3,170,731 A 2/1965 Caldemeyer et al.
3,173,587 A 3/1965 Stearns
3,182,377 A 5/1965 Hoven et al.
3,194,601 A 7/1965 Hoven et al.
3,197,254 A 7/1965 Hendrickson
3,233,939 A 2/1966 Chapman
3,246,927 A 4/1966 Klassen
3,264,034 A 8/1966 Lawson
3,300,246 A 1/1967 Bouche
3,305,044 A 2/1967 Van Loo et al.
3,310,300 A 3/1967 Lawson
D208,468 S 9/1967 Okiyama
3,343,870 A 9/1967 Thatcher et al.
3,369,658 A 2/1968 Hasselmann
D210,364 S 3/1968 Lindberg
3,446,530 A 5/1969 Rowland
3,479,084 A 11/1969 Van Ryn
D216,305 S 12/1969 Gazit
3,506,167 A 4/1970 Orr
3,528,096 A 9/1970 Moberg
3,531,552 A 9/1970 Getz et al.
3,544,163 A 12/1970 Krein
3,547,488 A 12/1970 Barnes
3,550,958 A 12/1970 Krein
3,556,588 A 1/1971 Monyer et al.
3,583,590 A 6/1971 Ferraro
3,589,762 A 6/1971 Henrikson
3,594,037 A 7/1971 Sherman
D221,642 S 8/1971 Bayes
D222,350 S 10/1971 Sundberg
3,641,614 A 2/1972 Newsome
3,647,260 A 3/1972 Grant et al.
3,657,854 A 4/1972 Tipton
3,695,687 A 10/1972 Uyeda
3,695,693 A 10/1972 Acton et al.
3,714,678 A 2/1973 Weisz et al.
3,717,289 A 2/1973 Laurizio
3,722,950 A 3/1973 Harnick
3,727,975 A 4/1973 Anderson
3,744,843 A 7/1973 Barecki et al.
D228,104 S 8/1973 Blodee
3,757,984 A 9/1973 Barton
3,759,572 A 9/1973 Koepke
3,762,765 A 10/1973 Piretti
3,762,766 A 10/1973 Barecki et al.
3,784,249 A 1/1974 Hendrickson et al.
3,785,600 A 1/1974 Padovano
3,796,459 A 3/1974 Weber
3,813,149 A 5/1974 Lawrence, III et al.
3,847,433 A 11/1974 Acton et al.
3,850,476 A 11/1974 Day
3,857,605 A 12/1974 Fantoni
3,858,766 A 1/1975 Schiemann
3,874,731 A 4/1975 Jordan
3,877,674 A 4/1975 Cerutti
3,880,467 A 4/1975 Tischler
3,885,766 A 5/1975 Resch et al.
3,889,999 A 6/1975 Mackintosh
3,899,207 A 8/1975 Mueller
3,901,417 A 8/1975 Schiemann
3,902,754 A 9/1975 Braeuning
3,933,268 A 1/1976 Buske
3,960,405 A 6/1976 DeLong
3,976,326 A 8/1976 Grumblatt
4,000,586 A 1/1977 Vance et al.
4,052,101 A 10/1977 DeLong
4,054,316 A 10/1977 DeLong
4,077,669 A 3/1978 Fox
4,097,089 A 6/1978 Petersen
4,114,947 A 9/1978 Nelson
4,126,354 A 11/1978 DeLong et al.
4,133,579 A 1/1979 Springfield
D253,034 S 10/1979 Meyer et al.
4,179,158 A 12/1979 Flaum et al.
4,189,876 A 2/1980 Crossman et al.
4,216,994 A 8/1980 Benoit
4,240,663 A 12/1980 Locher
D258,866 S 4/1981 Houseman et al.
4,273,265 A 6/1981 Anderson
4,277,101 A 7/1981 Vogel
D260,058 S 8/1981 Ponzellini
4,297,763 A 11/1981 Lautenschlager
4,308,961 A 1/1982 Kunce
4,330,898 A 5/1982 Thompson et al.
D266,017 S 8/1982 Kellogg
4,348,053 A 9/1982 Strassle
4,453,363 A 6/1984 Koller
D274,699 S 7/1984 Epperson
4,493,172 A 1/1985 Jones
4,509,665 A 4/1985 Goodall
4,528,786 A 7/1985 Dinitz et al.
4,542,887 A 9/1985 Bethell et al.
4,547,092 A 10/1985 Vetter et al.
4,575,149 A 3/1986 Forestal et al.

(56) References Cited

U.S. PATENT DOCUMENTS 4,603,907 A 8/1986 Witzke
4,632,457 A 12/1986 Hofrichter et al.
4,650,100 A 3/1987 Echazabal, Jr.
4,691,828 A 9/1987 Slusarczyk et al.
4,694,531 A 9/1987 Foy
4,702,522 A 10/1987 Vail et al.
4,705,274 A 11/1987 Lubeck
4,723,816 A 2/1988 Selbert et al.
4,725,027 A 2/1988 Bekanich
4,726,554 A 2/1988 Sorrell
4,748,913 A 6/1988 Favaretto et al.
4,754,943 A 7/1988 Froutzis
4,761,035 A 8/1988 Urai
4,766,838 A 8/1988 Johnson
4,789,126 A 12/1988 Rice et al.
4,790,594 A 12/1988 Temos
4,799,632 A 1/1989 Baymak et al.
4,805,793 A 2/1989 Brandt et al.
4,828,208 A 5/1989 Peterson et al.
4,850,159 A 7/1989 Conner
4,850,502 A 7/1989 Davis
4,852,940 A 8/1989 Kanigowski
4,854,640 A 8/1989 Yokoyama
4,858,996 A 8/1989 Blodee
4,864,690 A 9/1989 Chen
4,865,377 A 9/1989 Musser et al.
4,883,319 A 11/1989 Scott
4,900,085 A 2/1990 Tobler
4,955,575 A 9/1990 Moore
4,960,137 A 10/1990 Pott et al.
4,984,768 A 1/1991 Kolber et al.
4,989,915 A 2/1991 Hansal
5,002,337 A 3/1991 Engel et al.
D315,867 S 4/1991 Hestehave et al.
5,020,286 A 6/1991 Hamar et al.
5,033,792 A 7/1991 Kanazawa
5,067,772 A 11/1991 Koa
5,087,096 A 2/1992 Yamazaki
5,098,156 A 3/1992 Vogel
5,108,016 A 4/1992 Waring
5,110,013 A 5/1992 Clark et al.
5,121,891 A 6/1992 Goldsmith
5,123,702 A 6/1992 Caruso
5,142,757 A 9/1992 Thary
D331,703 S 12/1992 Seguin et al.
5,167,336 A 12/1992 Lajovic
D335,453 S 5/1993 Marti
5,232,110 A 8/1993 Purnell
5,236,165 A 8/1993 Conway
5,236,247 A 8/1993 Hewko
5,246,270 A 9/1993 Vogel
5,282,662 A 2/1994 Bolsworth et al.
5,288,128 A 2/1994 Smith
5,306,072 A 4/1994 Caldwell
5,308,126 A 5/1994 Weger, Jr. et al.
5,316,375 A 5/1994 Breen
5,328,231 A 7/1994 Raymond
5,329,871 A 7/1994 Gibbs
5,342,110 A 8/1994 Merrick
5,375,914 A 12/1994 Donnelly
5,377,882 A 1/1995 Pham et al.
5,383,644 A 1/1995 Huse
5,393,126 A 2/1995 Boulva
5,400,928 A 3/1995 Resnick
5,406,994 A 4/1995 Mitchell et al.
D358,330 S 5/1995 Kahl
5,433,346 A 7/1995 Howe
5,470,128 A 11/1995 Kerkham
5,472,124 A 12/1995 Martushev
D365,983 S 1/1996 Triassi et al.
5,524,963 A * 6/1996 Barile ..... A47C 3/04 297/239
5,529,376 A 6/1996 Jovan et al.
5,538,165 A 7/1996 Frohn
5,547,247 A 8/1996 Dixon
5,549,072 A 8/1996 Maloney
5,553,923 A 9/1996 Bilezikjian
5,567,016 A 10/1996 Koprowski
5,597,097 A 1/1997 Morris
5,598,785 A 2/1997 Zaguroli, Jr.
5,601,335 A 2/1997 Woods et al.
5,609,395 A 3/1997 Burch
5,632,406 A 5/1997 Robbins, III
5,636,900 A 6/1997 Wilkie et al.
5,651,908 A 7/1997 Mansfield
5,658,043 A 8/1997 Davidson
5,661,945 A 9/1997 Henriksson et al.
5,671,868 A 9/1997 Herr
5,671,975 A 9/1997 Muller
5,681,085 A 10/1997 Nahoul
5,681,089 A 10/1997 Lin
5,683,136 A 11/1997 Baumann et al.
5,702,157 A 12/1997 Hurite
5,704,691 A 1/1998 Olson
5,711,355 A 1/1998 Kowalczyk
5,733,010 A 3/1998 Lewis et al.
D393,803 S 4/1998 Walter
5,740,947 A 4/1998 Flaig et al.
5,746,358 A 5/1998 Crosby
5,762,296 A 6/1998 Gilbert
5,762,396 A * 6/1998 Barile ..... A47C 3/04 297/239
5,765,911 A 6/1998 Sorenson
D396,967 S 8/1998 Yamazaki
5,788,332 A 8/1998 Hettinga
5,803,546 A 9/1998 Yamazaki
5,826,850 A 10/1998 Goldsmith
5,845,964 A 12/1998 Phoon
5,850,949 A 12/1998 Koerbel et al.
5,878,470 A 3/1999 Blansett
5,881,431 A 3/1999 Pieper, II et al.
5,890,761 A 4/1999 Miller
5,897,035 A 4/1999 Schlomer
5,899,526 A 5/1999 LaPointe et al.
5,899,531 A 5/1999 Koehler
5,924,608 A 7/1999 Chiu
5,931,528 A 8/1999 Shields
5,944,387 A 8/1999 Stumpf
5,944,388 A 8/1999 Saucier et al.
5,971,466 A 10/1999 Hashimoto
5,984,417 A 11/1999 Wang
5,985,188 A 11/1999 Jennings et al.
5,988,757 A 11/1999 Vishey et al.
6,012,773 A 1/2000 Best
6,019,413 A 2/2000 Scraver et al.
6,024,397 A 2/2000 Scraver et al.
6,029,858 A 2/2000 Srokose et al.
6,045,013 A 4/2000 Yang
6,050,455 A 4/2000 Soehnlen et al.
6,056,278 A 5/2000 Bullard et al.
6,068,161 A 5/2000 Soehnlen et al.
D426,162 S 6/2000 Olson
6,073,997 A 6/2000 Koh
6,082,591 A 7/2000 Healey
6,092,864 A 7/2000 Wycech et al.
6,095,603 A 8/2000 Hock
6,109,696 A * 8/2000 Newhouse ..... A47C 7/42 297/452.21
6,116,183 A 9/2000 Crow et al.
6,135,562 A 10/2000 Infanti
6,145,912 A 11/2000 Rice et al.
6,161,262 A 12/2000 Pfister
6,174,029 B1 * 1/2001 Swy ..... A47C 3/04 297/440.22
D438,119 S 2/2001 Meyer et al.
6,190,047 B1 2/2001 Haag et al.
6,196,425 B1 3/2001 Fielding et al.
6,206,469 B1 3/2001 Caruso et al.
6,220,658 B1 4/2001 Lukawski et al.
6,220,661 B1 4/2001 Peterson
D441,972 S 5/2001 Mitjans
6,224,149 B1 5/2001 Gevaert
6,226,819 B1 5/2001 Ogawa et al.
6,230,944 B1 5/2001 Castellano et al.

(56) References Cited

U.S. PATENT DOCUMENTS

D445,269 S 7/2001 Mitjans
D445,574 S 7/2001 Foster
D446,035 S 8/2001 Haney
D447,642 S 9/2001 Kimura
6,283,550 B1 9/2001 Vialatte et al.
6,286,902 B1 9/2001 Yoshimura
6,293,621 B1 9/2001 Marsh et al.
6,296,222 B1 10/2001 Whittaker
6,296,315 B1 10/2001 Jensen
D450,245 S 11/2001 Schultz
6,314,614 B1 11/2001 Kuehl
6,345,863 B1 2/2002 Laws et al.
6,349,449 B1 2/2002 Kuehl
6,352,307 B1 3/2002 Engman
6,360,924 B1 3/2002 Franzen
6,382,475 B1 5/2002 Weikinger
6,382,726 B2 5/2002 Bullesbach et al.
6,393,624 B1 5/2002 Iwashita
D458,140 S 6/2002 Hutchins
6,409,267 B1 6/2002 Pietrzak
6,425,153 B1 7/2002 Reswick
6,427,287 B1 8/2002 Brueckner et al.
6,428,100 B1 8/2002 Kain et al.
6,450,579 B1 9/2002 Nylander et al.
D465,664 S 11/2002 Stannard
6,474,744 B1 11/2002 Taylor et al.
6,477,738 B1 11/2002 Kremer et al.
6,478,381 B1 11/2002 Cramb, III et al.
6,491,346 B1 12/2002 Gupta et al.
6,494,344 B1 12/2002 Kressel, Sr.
6,499,158 B1 12/2002 Easterling
6,523,900 B1 2/2003 Conner et al.
6,554,353 B1 4/2003 Yu
6,565,157 B2 5/2003 Barile, Jr. et al.
6,578,922 B2 6/2003 Khedira et al.
6,582,020 B1 6/2003 Tenenboym et al.
6,588,612 B1 7/2003 Dorn et al.
D479,468 S 9/2003 Dorn et al.
D479,657 S 9/2003 Calatrava Valls
6,612,652 B1 9/2003 Tenenboym et al.
6,669,282 B2 12/2003 Piretti
D485,170 S 1/2004 Hay et al.
6,683,394 B1 1/2004 Gevaert
6,698,834 B2 3/2004 Olarte
6,729,685 B1 5/2004 Ebalobor
6,746,086 B1 6/2004 Foster
6,786,548 B2 9/2004 Pearce et al.
6,786,549 B1 9/2004 Olarte
6,789,549 B2 9/2004 Johnson
6,793,281 B2 9/2004 Duerr et al.
6,805,394 B2 10/2004 Kettler et al.
D498,077 S 11/2004 Tonizzo
6,839,950 B2 1/2005 Guillot
6,845,885 B2 1/2005 Morgenroth
6,857,699 B2 2/2005 Ashton et al.
6,874,850 B2 4/2005 Berkowicz
D506,137 S 6/2005 Durivage
6,907,703 B2 6/2005 Gonzalez
6,932,228 B1 8/2005 Darr et al.
D509,144 S 9/2005 Snyder
6,942,295 B1 9/2005 Lopez
6,964,345 B2 11/2005 Wetherell, Jr. et al.
6,968,983 B2 11/2005 Laible
D514,940 S 2/2006 Darr et al.
7,000,794 B2 2/2006 Soehnlen et al.
7,000,989 B2 2/2006 Fisher
D517,413 S 3/2006 Murphy
D519,378 S 4/2006 Abadinsky
7,032,272 B2 4/2006 Haenlein
D520,367 S 5/2006 Morris
D520,765 S 5/2006 Piano
7,063,381 B2 6/2006 Scahill et al.
7,073,858 B2 7/2006 Fisher et al.
D528,425 S 9/2006 Van Dorin et al.
7,100,983 B1 9/2006 Gant
7,108,447 B2 9/2006 Akkala et al.
D530,936 S 10/2006 Gehry
7,134,728 B1 11/2006 Buhrman
7,150,498 B2 12/2006 Svartvatn
7,182,214 B2 2/2007 Darr et al.
D537,648 S 3/2007 Moschini
7,204,553 B2 4/2007 Olarte
7,210,735 B2 5/2007 Lang
7,225,899 B2 6/2007 Molnar et al.
D549,983 S 9/2007 Olarte
D549,984 S 9/2007 Olarte
D556,058 S 11/2007 Bowers et al.
7,303,235 B1 12/2007 Fongers
D558,604 S 1/2008 Dohm et al.
D559,108 S 1/2008 Regas
D560,921 S 2/2008 Olarte
7,331,490 B2 2/2008 Yamana
7,370,910 B2 5/2008 Piretti
7,384,102 B2 6/2008 Chen et al.
D573,473 S 7/2008 Kruparova
D577,589 S 9/2008 Brieussel et al.
7,467,453 B2 12/2008 Olarte
7,469,966 B1 12/2008 Vallee
7,478,876 B2 1/2009 Olarte
7,490,392 B2 2/2009 Peterson
D589,807 S 4/2009 Gundrum et al.
D589,809 S 4/2009 Gundrum et al.
7,513,394 B2 4/2009 Bone
D594,669 S 6/2009 Asano
7,562,937 B2 7/2009 Baumann
7,594,696 B2 9/2009 Girard
7,661,549 B2 2/2010 Rae
7,690,732 B2 4/2010 Olarte
7,695,061 B2 4/2010 Olarte
D616,658 S 6/2010 Niermeyer
7,774,880 B1 8/2010 Botts
D625,774 S 10/2010 Nirenberg
7,814,636 B2 10/2010 Olarte
7,828,380 B2 11/2010 Olarte
7,866,689 B2 1/2011 Saberan
7,882,795 B1 2/2011 Snyder
7,901,004 B2 3/2011 Figueras Mitjans
7,905,546 B2 3/2011 Conner
7,950,739 B2 5/2011 King
7,959,044 B1 6/2011 Christian et al.
7,971,935 B2 7/2011 Saez et al.
8,020,254 B2 9/2011 Lin
8,075,055 B2 12/2011 Olarte
8,091,744 B2 1/2012 Zwahlen
8,091,945 B2 1/2012 Hancock et al.
8,104,838 B2 1/2012 Tsai
8,109,566 B2 2/2012 Koh
8,157,132 B1 4/2012 Johnson et al.
8,201,588 B2 6/2012 Bonner
8,201,699 B2 6/2012 Zummo et al.
8,245,891 B2 8/2012 Eriksen
D672,657 S 12/2012 Hall
D672,980 S 12/2012 Mitjans
8,414,072 B2 4/2013 Phillips
8,490,335 B2 7/2013 LaForest
8,491,053 B2 7/2013 Stringer
D687,642 S 8/2013 Hsuan-Chin
D687,921 S 8/2013 Jung et al.
D687,922 S 8/2013 Jung et al.
D689,297 S 9/2013 Su
D690,203 S 9/2013 Hall et al.
D690,952 S 10/2013 Becker
D693,426 S 11/2013 Mehra et al.
8,573,704 B2 11/2013 Peters et al.
8,578,974 B2 11/2013 Bonner
D696,956 S 1/2014 Jung et al.
8,640,930 B2 2/2014 Nunez et al.
8,662,322 B2 3/2014 Magnusson et al.
8,662,359 B1 3/2014 Hickey
D703,458 S 4/2014 Nakamura et al.
8,721,003 B2 5/2014 Waite et al.
8,727,187 B2 5/2014 Magley
8,727,445 B2 5/2014 De Maina
8,763,826 B1 7/2014 Smith et al.

(56) References Cited

U.S. PATENT DOCUMENTS 8,813,657 B2 8/2014 Winter et al.
8,820,827 B2 9/2014 Olarte
8,820,836 B2 9/2014 Stewart et al.
8,827,369 B2 9/2014 Izawa et al.
8,833,617 B1 9/2014 Compton et al.
8,910,835 B2 12/2014 Ouderkirk
8,960,454 B2 2/2015 Magnusson et al.
8,967,714 B2 3/2015 Machael et al.
8,968,041 B2 3/2015 Rubbo
8,973,990 B2 3/2015 Krupiczewicz et al.
9,033,414 B2 5/2015 Olarte
9,060,614 B1 6/2015 Gibilterra
D734,621 S 7/2015 Su
9,096,357 B2 8/2015 Brausen
9,113,715 B2 8/2015 Olarte
9,295,334 B2 3/2016 Olarte
9,380,870 B2 7/2016 Babick
9,399,876 B2 7/2016 Magnus
D764,295 S 8/2016 Gieske et al.
9,420,890 B2 8/2016 Lee
9,565,949 B2 2/2017 Peterson
D781,107 S 3/2017 Welsch et al.
9,630,539 B2 4/2017 Yokoyama et al.
D786,575 S 5/2017 Olarte
9,642,464 B2 5/2017 Magnus
9,669,972 B2 6/2017 Stratton
9,693,630 B2 7/2017 Jacobs et al.
9,693,631 B2 7/2017 Jacobs et al.
D804,313 S 12/2017 Reches et al.
D808,676 S 1/2018 Bellissimo
9,873,354 B2 1/2018 Poulos et al.
D810,573 S 2/2018 Vazin
9,926,104 B2 3/2018 Olarte
D821,880 S 7/2018 Olarte
10,010,178 B2 7/2018 Maughan
10,273,056 B2 4/2019 Hoffman et al.
D847,527 S 5/2019 Borras Pons
10,315,800 B2 6/2019 Olarte
10,349,749 B2 7/2019 Su
10,485,348 B1 11/2019 Olarte
10,517,400 B2 * 12/2019 Olarte ..... A47C 3/045
10,518,933 B2 12/2019 Dorn
10,555,610 B2 2/2020 Jacobs et al.
D876,852 S 3/2020 Bellissimo
10,588,414 B2 3/2020 Olarte
10,647,471 B2 5/2020 Olarte
10,674,825 B2 6/2020 Olarte
10,681,983 B2 6/2020 Olarte
10,829,277 B2 11/2020 Olarte
10,835,045 B2 11/2020 Olarte
D906,118 S 12/2020 Olarte
10,881,210 B2 1/2021 Olarte
10,944,890 B2 3/2021 Tsuchiya et al.
10,994,890 B2 5/2021 Olarte
11,008,108 B2 5/2021 Gilbert
11,026,515 B2 6/2021 Olarte
11,071,389 B2 7/2021 Olarte
11,224,292 B2 1/2022 Hashimoto et al.
11,457,744 B2 10/2022 Olarte
11,464,337 B1 10/2022 Olarte
11,470,969 B2 10/2022 Olarte
11,505,367 B2 11/2022 Olarte
D979,272 S 2/2023 Olarte
11,684,160 B1 6/2023 Olarte
11,690,458 B2 * 7/2023 Policicchio ..... A47C 13/005
297/440.14
11,712,118 B2 8/2023 Olarte
11,737,568 B2 8/2023 Olarte
11,793,315 B2 10/2023 Olarte
11,800,932 B1 10/2023 Olarte
D1,019,161 S 3/2024 Olarte
12,011,099 B2 6/2024 Olarte
12,064,035 B2 8/2024 Olarte
12,150,558 B2 11/2024 Olarte
2001/0023510 A1 9/2001 Masubuchi
2001/0054628 A1 12/2001 Harbaugh et al.
2002/0038970 A1 4/2002 Leng et al.
2002/0053822 A1 * 5/2002 Ware ..... A47C 7/445
297/239
2002/0117885 A1 * 8/2002 Barile, Jr. ..... A47C 7/282
297/452.52
2002/0166857 A1 11/2002 Schwaikert
2002/0167789 A1 11/2002 Novin et al.
2003/0047976 A1 3/2003 Hannon et al.
2003/0062759 A1 4/2003 Gupta et al.
2003/0085607 A1 5/2003 Jones et al.
2003/0090136 A1 5/2003 Olarte
2003/0102703 A1 6/2003 Tenenboym et al.
2003/0132184 A1 7/2003 Dorn et al.
2004/0041455 A1 3/2004 Tenbroeck et al.
2004/0084943 A1 5/2004 Fisher
2004/0099672 A1 5/2004 Perlman
2004/0100134 A1 5/2004 Plant et al.
2004/0178222 A1 9/2004 Clausen et al.
2004/0217635 A1 * 11/2004 Barile, Sr. ..... A47C 3/04
297/448.1
2005/0017554 A1 1/2005 Mizelle et al.
2005/0017558 A1 1/2005 Fewchuk
2005/0051575 A1 3/2005 Durivage
2005/0092780 A1 5/2005 Yamana
2005/0099052 A1 5/2005 Bertolini et al.
2005/0127740 A1 6/2005 Dowty
2005/0140186 A1 6/2005 Piretti
2005/0146180 A1 7/2005 Fisher et al.
2005/0168032 A1 8/2005 Olarte
2005/0173954 A1 8/2005 Weber et al.
2005/0194823 A1 9/2005 Perry et al.
2005/0194829 A1 9/2005 Aerts
2005/0242651 A1 11/2005 Peitz et al.
2005/0264060 A1 12/2005 Cesaroni et al.
2006/0037930 A1 2/2006 Darr et al.
2006/0080817 A1 4/2006 Klinker
2006/0081662 A1 4/2006 Miura
2006/0202536 A1 9/2006 Luchetti et al.
2006/0238004 A1 10/2006 Conner et al.
2006/0244301 A1 11/2006 Jeffries
2006/0255642 A1 11/2006 Epaud et al.
2007/0017886 A1 1/2007 Kao
2007/0018495 A1 * 1/2007 Xiang ..... A47C 31/02
297/452.59
2007/0029858 A1 2/2007 Grable et al.
2007/0040090 A1 2/2007 Fay
2007/0063568 A1 3/2007 Figueras Mitjans
2007/0120402 A1 5/2007 Bonzini
2007/0138849 A1 6/2007 Olarte
2007/0170759 A1 7/2007 Nolan et al.
2007/0210638 A1 9/2007 Adragna et al.
2007/0216205 A1 9/2007 Davis
2008/0036266 A1 2/2008 Battey et al.
2008/0084104 A1 4/2008 VanHorn
2008/0105173 A1 5/2008 Weber
2008/0203790 A1 8/2008 Olarte
2008/0284215 A1 11/2008 Stauber
2009/0039078 A1 2/2009 Sanfilippo et al.
2009/0045226 A1 2/2009 Munlin
2009/0051207 A1 2/2009 Behrens et al.
2009/0121534 A1 5/2009 Brauning
2009/0139054 A1 6/2009 Burnley
2009/0255893 A1 10/2009 Zummo et al.
2009/0273211 A1 11/2009 Hancock et al.
2009/0284057 A1 * 11/2009 Kulish ..... A47C 3/04
297/239
2010/0171345 A1 7/2010 Powell et al.
2010/0176646 A1 7/2010 Rowland et al.
2010/0180399 A1 7/2010 Patzer et al.
2010/0194160 A1 8/2010 Machael et al.
2010/0201165 A1 8/2010 Dankovich
2010/0289306 A1 * 11/2010 Saul ..... A47C 3/04
297/239
2011/0029123 A1 2/2011 Olarte
2011/0108691 A1 5/2011 Alves et al.
2011/0115269 A1 5/2011 Roeder et al.
2011/0198902 A1 8/2011 Renbarger et al.
2011/0233236 A1 9/2011 Brown et al.

(56) References Cited

U.S. PATENT DOCUMENTS

| | | | | |
|---|---|---|---|---|
| 2012/0126596 | A1* | 5/2012 | Olarte | A47C 3/04 297/239 |
| 2012/0193318 | A1 | 8/2012 | Meager | |
| 2012/0228338 | A1 | 9/2012 | Magley, II | |
| 2012/0228918 | A1 | 9/2012 | Takahashi et al. | |
| 2012/0247313 | A1 | 10/2012 | Peters | |
| 2012/0248837 | A1 | 10/2012 | Peters | |
| 2012/0261971 | A1 | 10/2012 | Olarte | |
| 2012/0280001 | A1 | 11/2012 | Leadbeater | |
| 2012/0325718 | A1 | 12/2012 | Larsen | |
| 2013/0057036 | A1 | 3/2013 | Olarte | |
| 2013/0082500 | A1 | 4/2013 | Line et al. | |
| 2013/0255797 | A1 | 10/2013 | Coulon et al. | |
| 2013/0299522 | A1 | 11/2013 | Magley, II | |
| 2014/0021222 | A1 | 1/2014 | Forbis et al. | |
| 2014/0144948 | A1 | 5/2014 | Brausen | |
| 2014/0165331 | A1 | 6/2014 | Kang et al. | |
| 2014/0225404 | A1 | 8/2014 | Ramirez Magaña | |
| 2014/0232153 | A1 | 8/2014 | Bell et al. | |
| 2014/0239678 | A1 | 8/2014 | Todd | |
| 2014/0252836 | A1 | 9/2014 | Olarte | |
| 2014/0283337 | A1 | 9/2014 | Triebold et al. | |
| 2014/0325920 | A1 | 11/2014 | Ugolini et al. | |
| 2014/0332568 | A1 | 11/2014 | Stratton | |
| 2015/0015051 | A1* | 1/2015 | Huang | A47C 3/04 297/445.1 |
| 2015/0021964 | A1 | 1/2015 | Jacobs et al. | |
| 2015/0028641 | A1 | 1/2015 | Stent et al. | |
| 2015/0054322 | A1 | 2/2015 | Jacobs et al. | |
| 2015/0130236 | A1 | 5/2015 | Rogers | |
| 2015/0150380 | A1 | 6/2015 | Oh et al. | |
| 2015/0150381 | A1 | 6/2015 | Lee | |
| 2015/0158213 | A1 | 6/2015 | Mogi et al. | |
| 2015/0282622 | A1 | 10/2015 | Kumazawa | |
| 2015/0296986 | A1 | 10/2015 | Rogers | |
| 2015/0374130 | A1 | 12/2015 | Jacobs et al. | |
| 2016/0255960 | A1* | 9/2016 | Piretti | A47C 7/002 |
| 2016/0288910 | A1 | 10/2016 | Udriste et al. | |
| 2016/0316916 | A1* | 11/2016 | Pectol | A47C 7/445 |
| 2016/0331138 | A1 | 11/2016 | Olarte | |
| 2016/0331143 | A1 | 11/2016 | Johnson et al. | |
| 2017/0029168 | A1 | 2/2017 | Olarte | |
| 2017/0057130 | A1 | 3/2017 | Sameshima et al. | |
| 2017/0079440 | A1 | 3/2017 | Todd | |
| 2017/0127836 | A1* | 5/2017 | Maughan | A47C 3/04 |
| 2017/0164746 | A1 | 6/2017 | Phillips | |
| 2017/0297766 | A1 | 10/2017 | Olarte | |
| 2017/0320415 | A1 | 11/2017 | Mueller et al. | |
| 2017/0327281 | A1 | 11/2017 | Cross | |
| 2018/0098634 | A1 | 4/2018 | Smith et al. | |
| 2018/0177300 | A1 | 6/2018 | Jacobs et al. | |
| 2019/0176669 | A1 | 6/2019 | Noro et al. | |
| 2019/0281973 | A1 | 9/2019 | Coates et al. | |
| 2019/0329673 | A1 | 10/2019 | Popescu | |
| 2019/0374035 | A1 | 12/2019 | Olarte | |
| 2020/0154892 | A1 | 5/2020 | Olarte | |
| 2020/0189739 | A1 | 6/2020 | Schultz et al. | |
| 2020/0216178 | A1 | 7/2020 | Lin et al. | |
| 2021/0052077 | A1 | 2/2021 | Smith et al. | |
| 2021/0219728 | A1 | 7/2021 | Plant et al. | |
| 2021/0321776 | A1 | 10/2021 | Plant et al. | |
| 2021/0393035 | A1* | 12/2021 | Arnold | A47C 4/03 |
| 2022/0047082 | A1* | 2/2022 | Andersson | F16B 12/44 |
| 2022/0361677 | A1 | 11/2022 | Olarte | |
| 2023/0047482 | A1 | 2/2023 | Olarte | |
| 2023/0312107 | A1 | 10/2023 | Valdes de la Garza | |
| 2023/0320489 | A1 | 10/2023 | Olarte | |

FOREIGN PATENT DOCUMENTS

| | | | | |
|---|---|---|---|---|
| AU | 2019204079 | B2 | 1/2020 | |
| CA | 2465896 | | 5/2003 | |
| CA | 2465896 | A1 | 5/2003 | |
| CA | 2678854 | | 8/2008 | |
| CA | 2678854 | A1 | 8/2008 | |
| CA | 2847538 | | 3/2013 | |
| CA | 2847538 | A1 | 3/2013 | |
| CA | 2904885 | | 10/2014 | |
| CA | 2904885 | A1 | 10/2014 | |
| CA | 3045820 | | 12/2019 | |
| CA | 3045820 | A1 | 12/2019 | |
| CA | 3045828 | | 12/2019 | |
| CA | 3045828 | A1 | 12/2019 | |
| CA | 3116366 | | 5/2020 | |
| CA | 3116366 | A1 | 5/2020 | |
| CA | 3152059 | | 9/2022 | |
| CA | 3152059 | A1 | 9/2022 | |
| CN | 202908255 | | 5/2013 | |
| CN | 208610259 | | 3/2019 | |
| DE | 1821874 | | 11/1960 | |
| DE | 19530156 | | 2/1997 | |
| DE | 102007024550 | | 11/2008 | |
| EP | 0188002 | | 7/1986 | |
| EP | 0241628 | A1 * | 10/1987 | A47C 4/02 |
| EP | 2114199 | | 9/2012 | |
| EP | 2114199 | B1 | 9/2012 | |
| FR | 2167714 | | 8/1973 | |
| GB | 180054 | | 5/1922 | |
| GB | 454332 | | 9/1936 | |
| GB | 493316 | | 10/1938 | |
| GB | 637911 | | 5/1950 | |
| GB | 1133972 | | 11/1968 | |
| GB | 1464502 | | 2/1977 | |
| GB | 2098471 | | 11/1982 | |
| GB | 2274391 | | 7/1994 | |
| GB | 2343443 | | 5/2000 | |
| JP | 01175564 | | 7/1989 | |
| JP | 06198087 | | 7/1994 | |
| JP | H1191754 | | 4/1999 | |
| JP | 2005527438 | | 9/2005 | |
| JP | 2012249948 | | 12/2012 | |
| KR | 200341044 | | 2/2004 | |
| WO | WO9608985 | | 3/1995 | |
| WO | WO0016661 | | 3/2000 | |
| WO | 2003039297 | A2 | 5/2003 | |
| WO | WO2003039297 | | 5/2003 | |
| WO | 2005069799 | A2 | 8/2005 | |
| WO | WO2005069799 | | 8/2005 | |
| WO | WO2007034007 | | 3/2007 | |
| WO | 2008103323 | A1 | 8/2008 | |
| WO | WO2008103323 | | 8/2008 | |
| WO | WO2011022585 | | 2/2011 | |
| WO | WO2012054799 | | 4/2012 | |
| WO | 2012142394 | A1 | 10/2012 | |
| WO | WO2012142394 | | 10/2012 | |
| WO | 2013036514 | A1 | 3/2013 | |
| WO | WO2013036514 | | 3/2013 | |
| WO | WO2013172529 | | 11/2013 | |
| WO | 2014164246 | A1 | 10/2014 | |
| WO | WO2014164246 | | 10/2014 | |
| WO | 2016183299 | A1 | 11/2016 | |
| WO | WO2016183299 | | 11/2016 | |
| WO | WO2017155562 | | 9/2017 | |
| WO | WO2019065589 | | 4/2019 | |
| WO | 2020102690 | A1 | 5/2020 | |
| WO | WO2020102690 | | 5/2020 | |

* cited by examiner

STACKING CHAIR WITH REMOVABLE BACK

FIELD OF THE INVENTION

The following relates to chairs and more particularly moveable chairs which can be used when needed and taken out of the way when not.

BACKGROUND OF THE INVENTION

Stacking chairs are used in event spaces that require flexibility. These chairs will be placed on carts when not in use and put into storage. When needed for an event, the chairs can be arranged in rows for e.g. a conference/convention or church and then moved out of the way when a more open space plan is needed. As a result of these chairs being moved much more frequently than chairs which are bolted to the floor (fixed chairs), the upholstery on these moveable chairs can be come damaged and dirty more frequently.

Furthermore, some known designs of moveable chairs can be very expensive to transport in large quantities due to their construction.

SUMMARY OF THE INVENTION

It is therefore an object of the present invention to provide a comfortable stacking chair which allows for easy replacement of upholstery.

It is a further object of the present invention to provide a sturdy an economical stacking chair which can be easily broken down for shipping to conserve space.

These and other objects are achieved by providing a stacking chair whose back can be removed and seat removed to allow for both easy shipping and easy removal and replacement of the upholstery.

In certain aspects the stacking chair system is provided comprising a frame with four legs, two being front legs and two being rear legs. The seat is secured to the frame in a fixed position, the seat being upholstered and including a foam cushion supported by flexible support. Two receivers are provided in the frame at a rear of the frame. The backrest includes a foam cushion which is upholstered and an inner frame supporting the foam cushion, the inner frame including two protrusions extending out of the upholstery wherein the each one of the two protrusions is configured to insert into one of the two receivers. A fastener is provided for each receiver and is configured to secure the protrusion to the corresponding receiver, wherein the backrest is removable upon removal of the fasteners.

In certain aspects the frame includes a support bar extending on either side of the seat and connected to a front curved section and a rear curved section, the front curved section connected to one of the front legs and the rear curved section connected to one of the rear legs, each of the four legs extending outwards and downwards with respect to the seat and the four legs in a fixed arrangement with respect to the seat. In other aspects the two front legs are arranged at a more vertical angle than the rear legs. In other aspects the seat includes rigid supports arranged around a peripheral edge thereof to define a rigid frame and wherein the flexible support is secured to the rigid frame and the rigid frame is removably secured to a side section of the frame. In still other aspects the foam cushion is arranged on top of the rigid frame.

In certain aspects the frame includes a rear cross bar and the each of two receivers are arranged as a tube extending from the cross bar, the two receivers spaced apart at a distance which is at least 50% or more a width of the seat, but less than a spacing between the rear legs. In still other aspects the seat includes a seat frame and the flexible support is secured to the seat frame, the seat frame includes a curved portion such that the seat includes a lower curved section which matches a curve of the frame adjacent the front legs.

In yet other aspects the seat frame is secured to the frame such that the seat frame rests on top of the frame with upholstery between the seat and the seat frame and fasteners passing through the frame and securing to the seat frame. In yet other aspects the receiver defines an opening with four flat sides. In still other aspects the protrusion includes a circular cross section. In other aspects the protrusion includes a boss defining a flat section and having a threaded feature adjacent thereto for receiving the fasteners. In other aspects the frame includes a rear cross bar and the receivers are secured to the rear cross bar at an attachment point which is lower than a lower surface of a flat section of the frame which is perpendicular to the rear cross bar.

In certain aspects a stacking chair system is provided including a frame with four legs, two being front legs and two being rear legs. A seat is secured to the frame in a fixed position, the seat including a seat frame which defines a perimeter with an interior opening and the seat frame includes at least a flat portion and a curved portion, the curved portion having a curve which matches a curve of the frame ad or adjacent the front legs and the flat portion configured to rest on top of flat portions of the frame, the seat frame contained in upholstery and the seat including a foam cushion positioned above the seat frame wherein the foam cushion is supported by a flexible support, the flexible support connected to the seat frame and extending across the interior opening. In other aspects seat fasteners pass through holes in the flat portions of the frame and through the upholstery to secure to threaded members of the seat frame. In still other aspects at least part of the upholstery is positioned between the seat frame and the flat portions of the frame with the upholstery in contact with the flat portions of the frame. In yet other aspects two receivers are provided in the frame at a rear of the frame and between the rear legs of the frame and the backrest includes a foam cushion which is upholstered and an inner frame supporting the foam cushion. The inner frame includes two protrusions extending out of the upholstery wherein the each one of the two protrusions is configured to insert into one of the two receivers. In still other aspects, a fastener is provided for each receiver configured to secure the protrusion to the corresponding receiver, wherein the backrest is removable upon removal of the fasteners. In yet other aspects the frame defines an opening which is a through opening and at least part of the seat is arranged to move into said opening when a user sits on the seat. In still other aspects the frame defines an opening which is a through opening and at least part of the seat is arranged to move through said opening when a user sits on the seat. In yet other aspects the opening is defined by at least four straight sections of the frame.

Other objects of the invention and its particular features and advantages will become more apparent from consideration of the following drawings and accompanying detailed description.

DETAILED DESCRIPTION OF THE INVENTION

Figure 1:
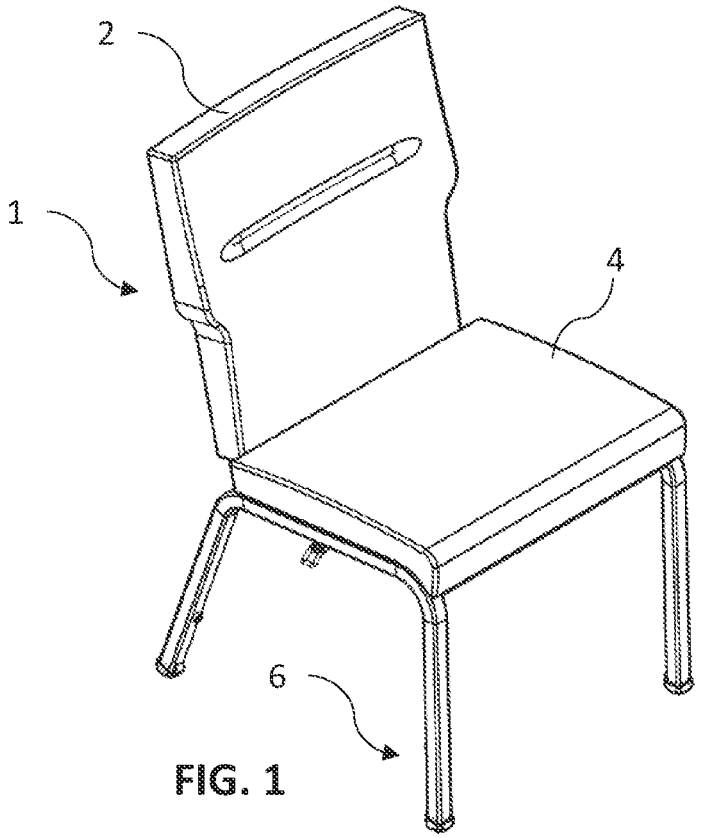
FIG. 1 is a perspective view of a chair according to the present invention.

Referring now to the drawings, wherein like reference numerals designate corresponding structure throughout the views. The following examples are presented to further illustrate and explain the present invention and should not be taken as limiting in any regard.

Figure 2:
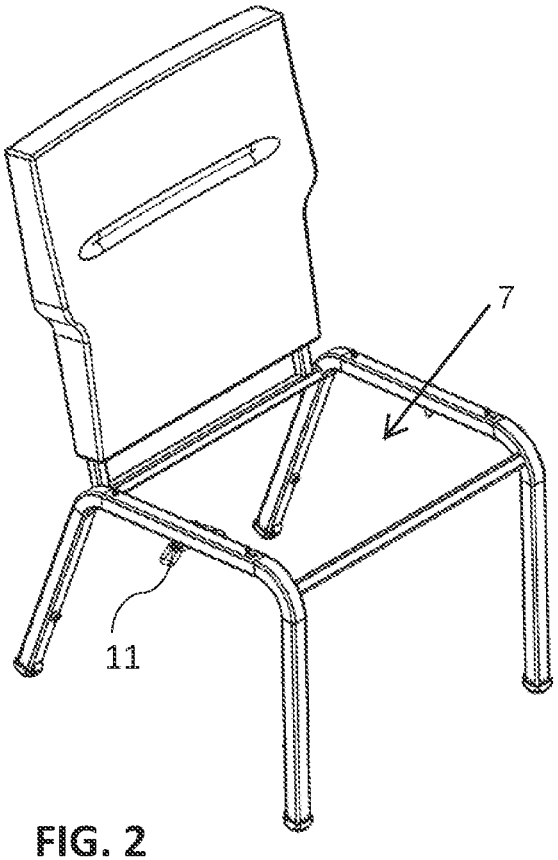
FIG. 2 is a perspective view of the chair of FIG. 1 with certain components removed.
Figure 3:
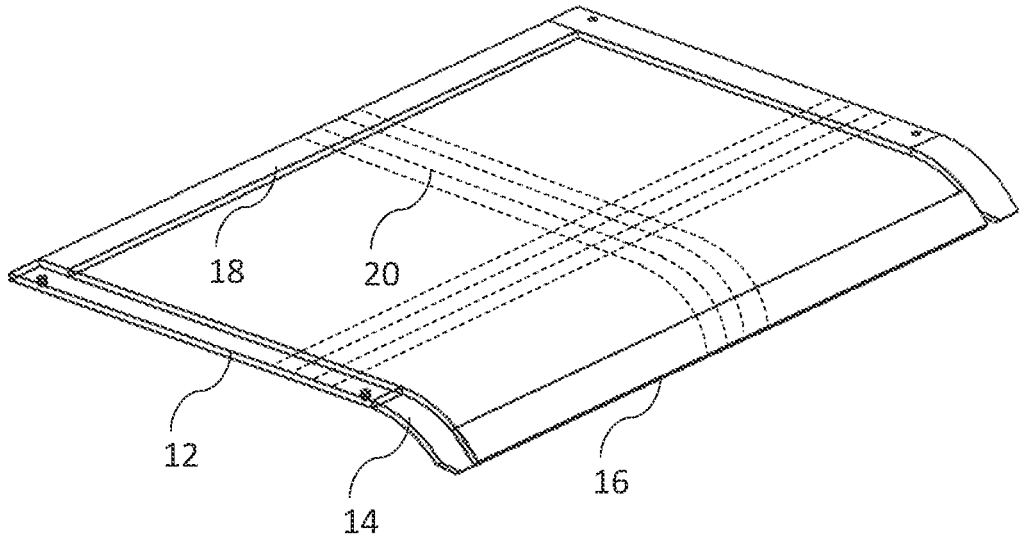
FIG. 3 is a perspective view of a component of the chair of FIG. 1.
Figure 4:
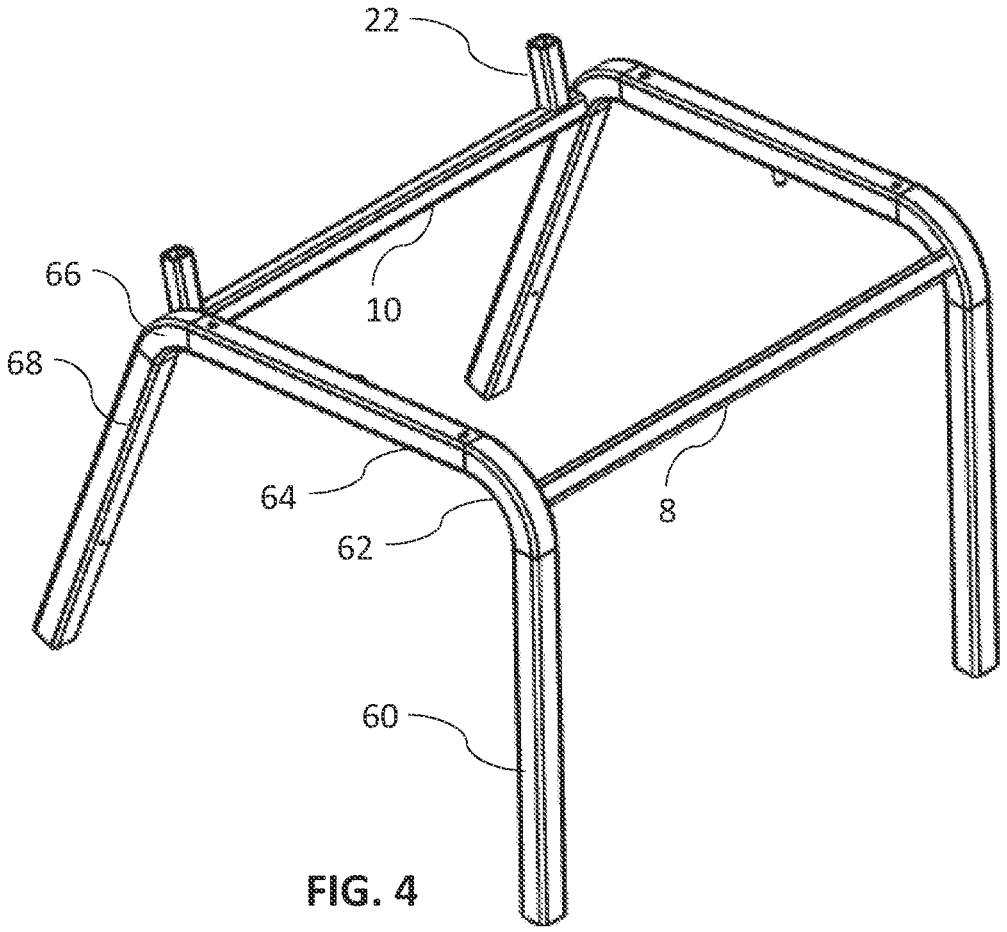
FIG. 4 is a perspective view of the bottom frame section of the chair of FIG. 1.
Figure 5:
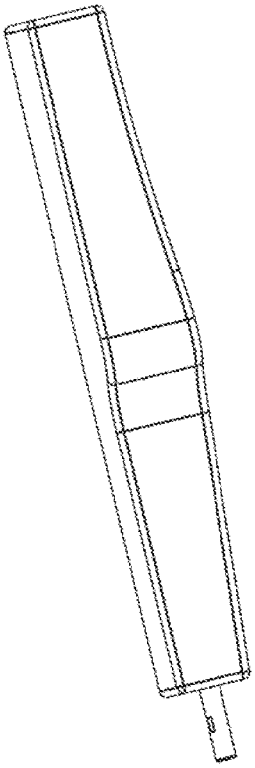
FIG. 5 is a side view of the backrest of the chair of FIG. 1.
Figure 6:
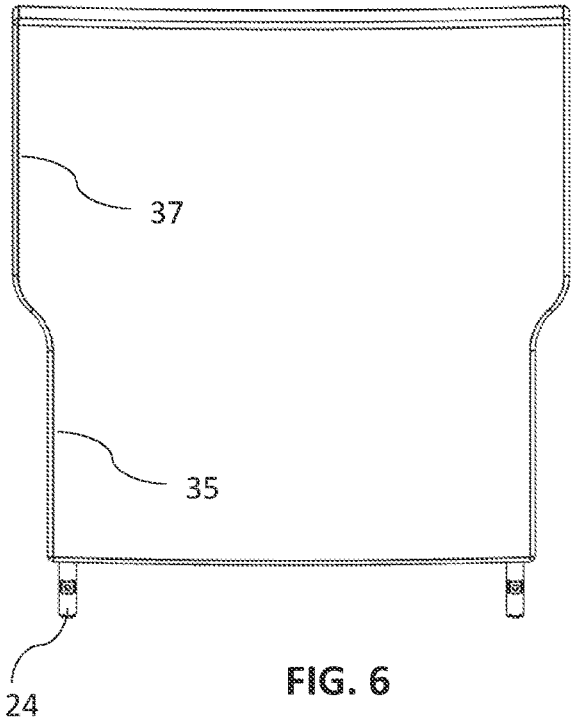
FIG. 6 is a rear view of the backrest of FIG. 5.
Figure 7:
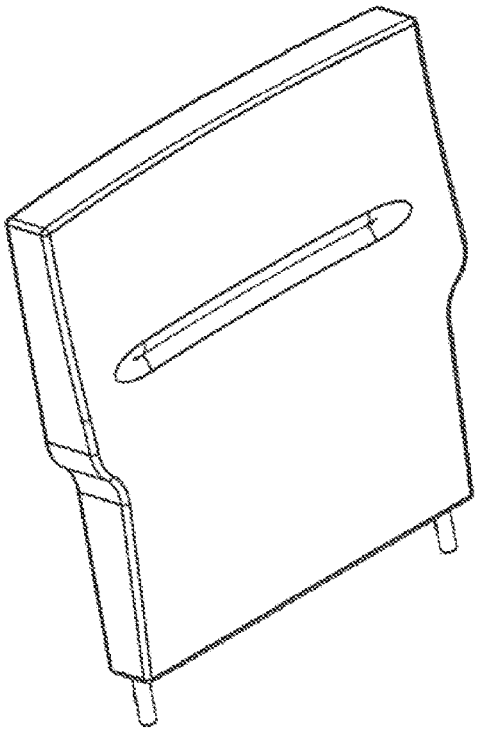
FIG. 7 is a perspective view of the backrest of FIG. 5.
Figure 8:
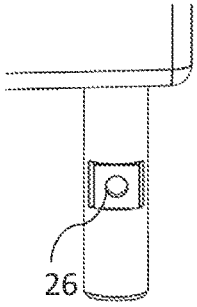
FIG. 8 is a detail view of part of FIG. 6.
Figure 10:
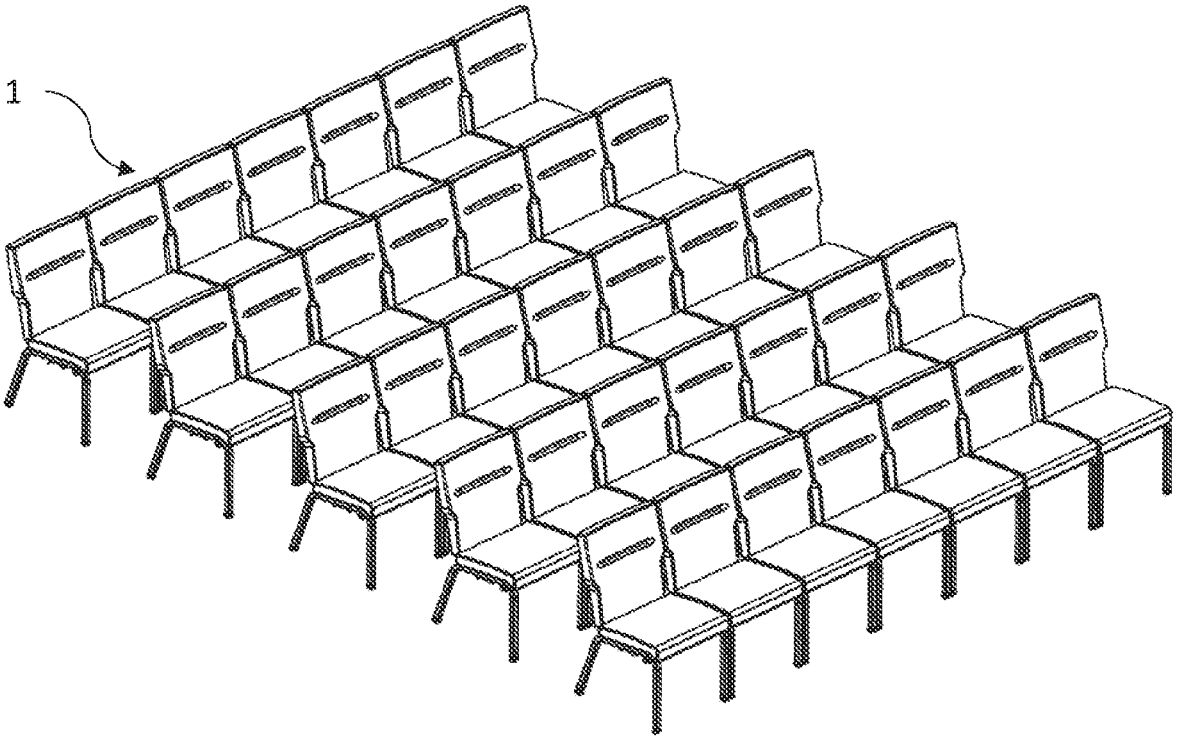
FIG. 10 shows a perspective view of multiple chairs according to FIG. 1 arranged in rows.

The chair 1 includes a backrest 2 and a seat 4. The seat 4 sits on top of frame 6 and the seat 4 is in a fixed position relative to the frame as is the backrest in that the seat 4 and backrest 2 do not have a tilting function. Connector piece 11 can be provided to assist in holding chairs together/in place in rows (FIG. 10). As can be seen in FIG. 2, the seat 4 can be removed. The backrest 2 and seat 4 are upholstered, thus the removal of the seat assists in replacing the upholstery cover in the even the originally installed one becomes worn, damaged or dirty. The seat 4 includes a support structure shown in FIG. 3 which is positioned under the foam cushion and on top of the lower frame (FIG. 4). The cushion support frame pieces Dec. 14, 2016/18 are preferably welded together and a flexible support 20 is placed over/around these pieces. On the seat frame, piece 14 is curved to match the curve of the corresponding frame section 62. The seat frame pieces Dec. 14, 2016/18 are preferably made from a relatively thin material, for example ½" or thinner metal, more preferably ⅜" or ¼" or thinner metal such as steel. In preferred embodiments, the metal includes threaded holes to receive the screws that secure the seat 4 to the frame 6 from underneath.

Figure 11:
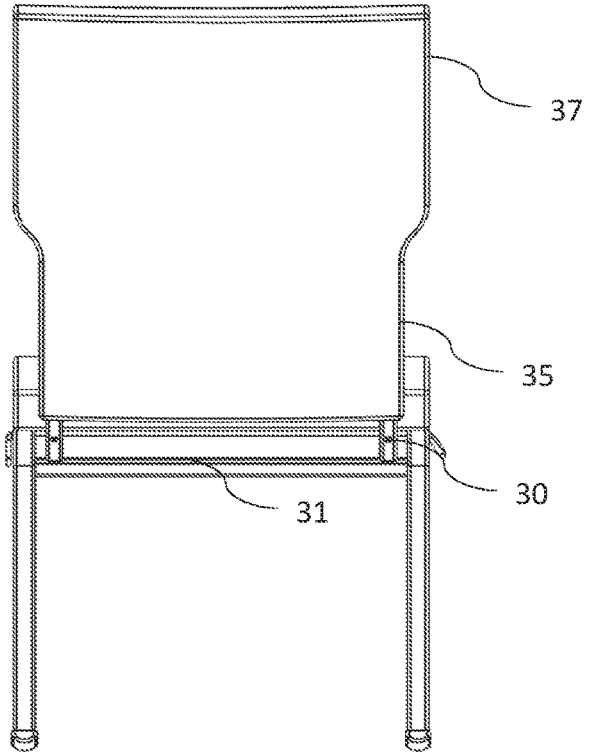
FIG. 11 is a rear view of the chair of FIG. 1.

Due to the use of the flexible support 20 and the foam placed thereon or molded there around, the bottom of the seat 4 will displace into or through the opening 7 when the seat is weighted, for example when someone sits on the seat. This flexible support 20 may be webbing or a seat sling material as example, but other materials may be used. A more rigid material may also be used for the support 20. A piece of foam rests on top of the flexible support 20 and the upholstery cover is placed over that assembly. The support frame can be attached/removed from the lower frame (FIG. 4) with screws. In this way, the screws can be removed and the seat frame and cushion pulled off the chair. The upholstery cover shown on the seat 4 is preferably removable, for example with a zipper, hook and loop fasteners (e.g. Velcro) or the like using a flap whose seam is shown in FIG. 11 (31). This allows for replacement/cleaning/repair of the upholstery cover as needed. Often chairs of the design shown are used in places of worship and thus the ability for user replacement of the upholstery is an important value feature. Specifically, places of worship would be able to gather volunteers to do a project of replace/renew all of the upholstery on the stacking chairs. As a result, the labor can be donated by members and the cost of having near new chairs is only the cost of new upholstery covers. Thus, the ease of re-upholstery for fixed seat stacking chairs is a significant advantage. Additionally, commercial venues can also replace upholstery with relative ease and a modest labor expense.

Figure 14:
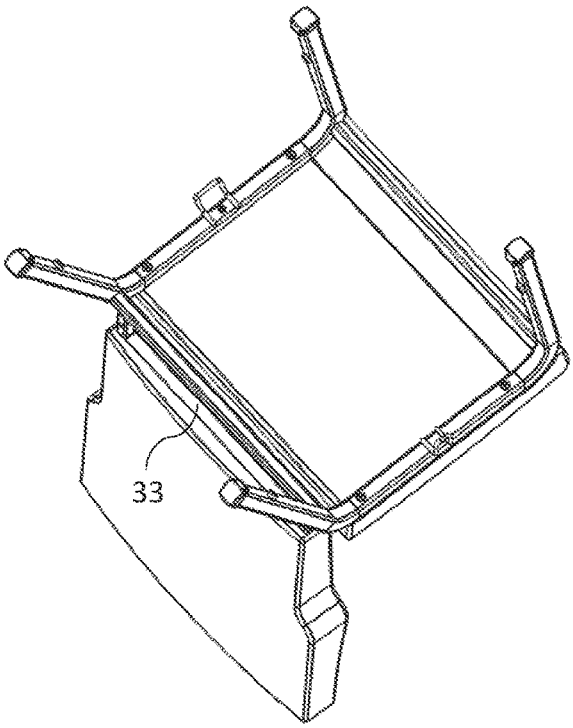
FIG. 14 is a bottom perspective view the chair of FIG. 1.

FIG. 4 shows additional details on the lower frame construction. Leg 60 is connected to curved section 62 which is connected to horizontal section 64. Another curved section is connected between horizontal section 64 and the rear leg 68. All of these sections 60/62/64/68 of the frame are fixed relative to each other, e.g. by welding or the sections can be formed by bending square tubing. Cross bars 10/8 connect each side of the frame and cross bar 10 includes back supports 22, preferably a welded connection is used. Preferably the frame pieces are hollow and particularly the back support 22 is hollow. Generally the square tubing will have chamfered or rounded corners. As shown in FIGS. 5-8, the back includes lower extensions 24 or protrusions which protrude from below the backrest's upholstered cushion. Like the seat upholstery, the back upholstery also has removable fasteners to enable removal and replacement (or cleaning) of the upholstery cover. FIG. 14 shows the flap 33 which can be opened to allow for removal of the upholstery cover. The lower extension 24 is shown as a round tube and boss 26 provides a flat surface to interface with the interior square tube of the back supports 22. The box 26 also includes a threaded hole, allowing screws to secure the backrest to the lower frame. Further, the lower section of the back 35 is narrower than the upper section 37 and there are curved and/or angled sections between the narrower 35 and wider 37 sections.

Figure 9:
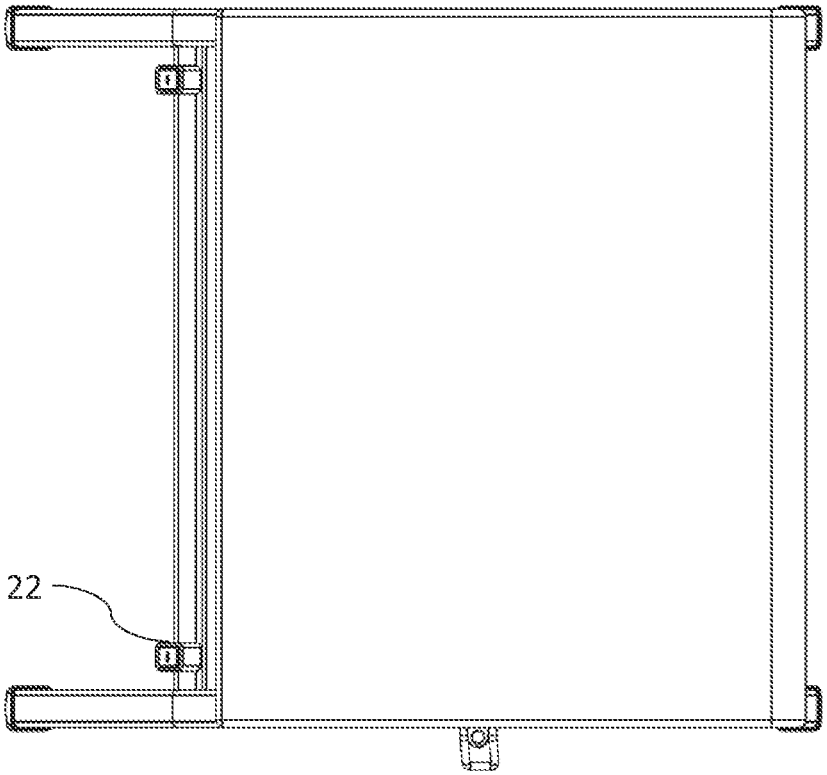
FIG. 9 is a top view of the chair of FIG. 1 with the backrest removed.
Figure 12:
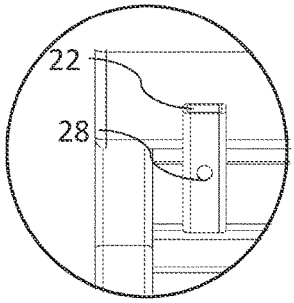
FIG. 12 is a detail view of FIG. 13.
Figure 13:
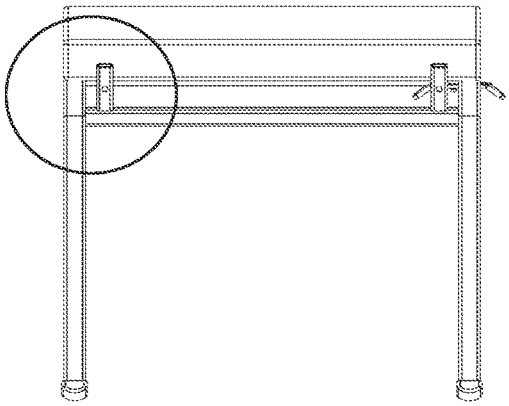
FIG. 13 is a rear view of the chair of FIG. 1 with the backrest removed.
Figure 15:
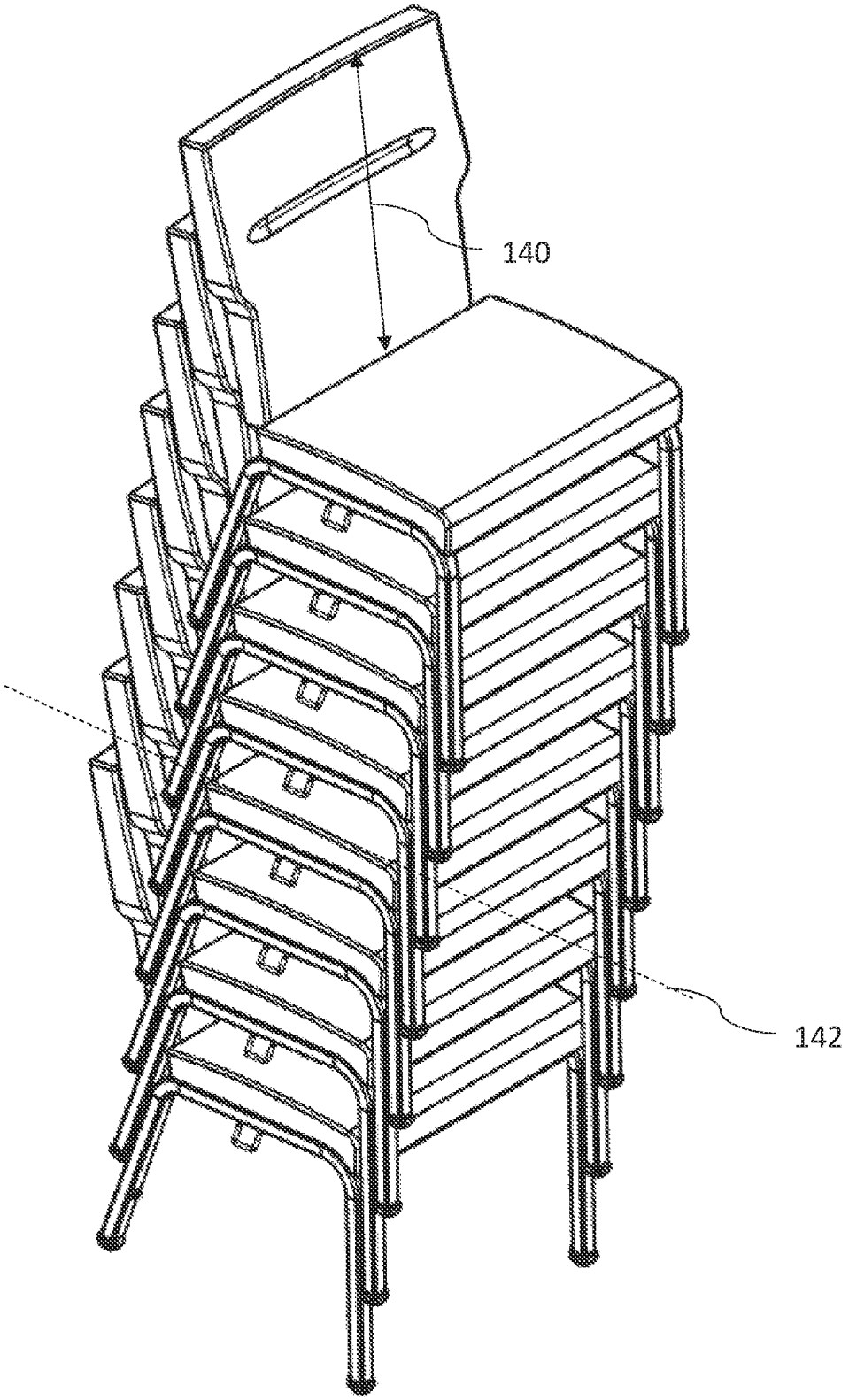
FIG. 15 is a perspective view of multiple chairs according to FIG. 1 stacked on top of each other.

As shown in FIGS. 9, 11 and 12, the back supports 22 are hollow and include a hole 28 through which a screw 30 can pass to secure the backrest 2 to the lower frame 6. These screws can also be removed to allow the backrest to likewise be removed. The preferred configuration when shipping chairs is with the backrest removed. Shipping typically has constrained height spaces in that the stack of chairs will cause interference with the backrest and the ceiling of the container/truck in which the chairs are placed. This space 140 is not well used in that the height of the backrest would allow about two or three additional chairs to be accommodated in that otherwise empty vertical space. This can be seen in the stack at FIG. 15 in that the top of the back of the lowest chair is roughly at the level of the seat of the $4^{th}$ chair in the stack 142, certainly two lower frames with upholstery and no backrest can fit in this space 140. Then, the backrests can be nested together in a stack with maximum density in that the front surface of one back is in contact with a rear surface of another and so on. Thus, there is minimum empty space in the container/truck, and specifically as to the backrests. As a result, more chairs can be shipped within a given space constraint.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A stacking chair comprising:

a frame with four legs, two being front legs and two being rear legs;

a seat secured to the frame in a fixed position, the seat being upholstered and including a foam cushion supported by flexible support;

two receivers in the frame at a rear of the frame;

a backrest comprising a foam cushion which is upholstered and an inner frame supporting the foam cushion, the inner frame including two protrusions extending out of the upholstery wherein the each one of the two protrusions is configured to insert into one of the two receivers;

a fastener for each receiver configured to secure the protrusion to the corresponding receiver, wherein the backrest is removable upon removal of the fasteners.

2. The stacking chair of claim 1 wherein the frame further comprises a support bar extending on either side of the seat and connected to a front curved section and a rear curved section, the front curved section connected to one of the front legs and the rear curved section connected to one of the rear legs, each of the four legs extending outwards and downwards with respect to the seat and the four legs in a fixed arrangement with respect to the seat.

3. The stacking chair of claim 2 wherein the two front legs are arranged at a more vertical angle than the rear legs.

4. The stacking chair of claim 2 wherein the seat includes rigid supports arranged around a peripheral edge thereof to define a rigid frame and wherein the flexible support is secured to the rigid frame and the rigid frame is removably secured to a side section of the frame.

5. The stacking chair of claim 4 wherein the foam cushion of the seat is arranged on top of the rigid frame.

6. The stacking chair of claim 1 wherein the frame further comprises a rear cross bar and the each of two receivers are arranged as a tube extending from the cross bar, the two receivers spaced apart at a distance which is at least 50% or more a width of the seat, but less than a spacing between the rear legs.

7. The stacking chair of claim 1 wherein the seat includes a seat frame and the flexible support is secured to the seat frame, the seat frame includes a curved portion such that the seat includes a lower curved section which matches a curve of the frame adjacent the front legs.

8. The stacking chair of claim 7 wherein the seat frame is secured to the frame such that the seat frame rests on top of the frame with upholstery between the seat and the seat frame and fasteners passing through the frame and securing to the seat frame.

9. The stacking chair of claim 1 wherein the receiver defines an opening with four flat sides.

10. The stacking chair of claim 9 wherein the protrusion includes a circular cross section.

11. The stacking chair of claim 10 wherein the protrusion includes a boss defining a flat section and having a threaded feature adjacent thereto for receiving the fasteners.

12. The stacking chair of claim 1 wherein the frame comprises a rear cross bar and the receivers are secured to the rear cross bar at an attachment point which is lower than a lower surface of a flat section of the frame which is perpendicular to the rear cross bar.

13. A stacking chair comprising:

a frame with four legs, two being front legs and two being rear legs;

a seat secured to the frame in a fixed position, the seat including a seat frame which defines a perimeter with an interior opening and the seat frame includes at least a flat portion and a curved portion, the curved portion having a curve which matches a curve of the frame at or adjacent the front legs and the flat portion configured to rest on top of flat portions of the frame, the seat frame contained in upholstery and the seat including a foam cushion positioned above the seat frame wherein the foam cushion is supported by a flexible support, the flexible support connected to the seat frame and extending across the interior opening.

14. The stacking chair of claim 13 further comprising seat fasteners which pass through holes in the flat portions of the frame and through the upholstery to secure to threaded members of the seat frame.

15. The stacking chair of claim 13 wherein at least part of the upholstery is positioned between the seat frame and the flat portions of the frame with the upholstery in contact with the flat portions of the frame.

16. The stacking chair of claim 13 further comprising:

two receivers in the frame at a rear of the frame and between the rear legs of the frame;

a backrest comprising a foam cushion which is upholstered and an inner frame supporting the foam cushion, the inner frame including two protrusions extending out of the upholstery wherein the each one of the two protrusions is configured to insert into one of the two receivers;

a fastener for each receiver configured to secure the protrusion to the corresponding receiver, wherein the backrest is removable upon removal of the fasteners.

17. The stacking chair of claim 13 wherein the frame defines an opening which is a through opening and at least part of the seat is arranged to move into said opening when a user sits on the seat.

18. The stacking chair of claim 17 wherein the opening is defined by at least four straight sections of the frame.

* * * * *